US007048354B2

(12) United States Patent
Kawatoko et al.

(10) Patent No.: US 7,048,354 B2
(45) Date of Patent: May 23, 2006

(54) INK JET RECORDING APPARATUS

(75) Inventors: Norihiro Kawatoko, Kanagawa (JP); Hiroshi Tajika, Kanagawa (JP); Yuji Konno, Kanagawa (JP); Takayuki Ogasawara, Kanagawa (JP); Tetsuya Edamura, Kanagawa (JP); Tetsuhiro Maeda, Kanagawa (JP); Atsuhiko Masuyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 10/214,300

(22) Filed: Aug. 8, 2002

(65) Prior Publication Data

US 2003/0043229 A1 Mar. 6, 2003

(30) Foreign Application Priority Data

Aug. 10, 2001 (JP) ..... 2001-244875

(51) Int. Cl.
*B41J 23/00* (2006.01)

(52) U.S. Cl. ..... 347/37

(58) Field of Classification Search ..... 347/37, 347/8, 14, 36; 400/48, 645, 23, 642, 545
See application file for complete search history.

(56) References Cited

U.S. PATENT DOCUMENTS 5,454,648 A * 10/1995 Lee ..... 400/48
6,231,159 B1 5/2001 Taniguro ..... 347/37
6,239,817 B1 5/2001 Meyer ..... 347/36
6,443,548 B1 * 9/2002 Takayama et al. ..... 347/14

FOREIGN PATENT DOCUMENTS

| | | |
|---|---|---|
| EP | 1043166 | 10/2000 |
| JP | 7-9714 | 1/1995 |
| JP | 2000-118058 | 4/2000 |
| JP | 2000-351205 | 12/2000 |
| JP | 2001-54955 | 2/2001 |

* cited by examiner

*Primary Examiner*—Lamson D. Nguyen
(74) *Attorney, Agent, or Firm*—Fitzpatrick, Cella Harper & Scinto

(57) ABSTRACT

Even if a recording medium is interfered with an opposed surface of a carriage and/or a recording head due to the curl of the recording medium, damage of the recording medium and the recording head is prevented by avoiding collision between an edge of the recording medium and the carriage and/or the recording head. The opposed surface (opposed to the recording medium) of the recording head 1 or the carriage is made smooth to form a smooth portion, and a moving range of the carriage is limited so that the smooth portion is not moved out of the recording medium, and a preliminary discharge receiving portion for receiving ink discharged to recover the recording head is disposed within the moving range of the carriage, and the moving range of the carriage is controlled to be limited when it is judged that curl will occur in the recording medium.

45 Claims, 14 Drawing Sheets

INK JET RECORDING APPARATUS

BACKGROUND OF THE INVENTION

1. Field of the Invention

The present invention relates to an ink jet recording apparatus in which recording is effected by discharging ink onto a recording medium from recording means mounted to a reciprocally moving carriage.

2. Related Background Art

Recording apparatuses of serial type in which a recording operation is carried out while scanning a recording head over a recording medium have been used in various image recording applications, and, particularly, ink jet recording apparatuses have been developed greatly since image quality has been enhanced due to recent progress of high resolving power and coloring ability.

Also in the ink jet recording apparatus, although a full multi head in which discharge ports for discharging ink droplets are arranged with high density has been used, in the recording head of serial type, image formation with higher resolving power can be performed by further increasing arrangement density of the discharge ports and by reducing an ink discharging amount per one dot.

On the other hand, in order to realize image quality approaching silver salt photography, various techniques such as, for example, a technique in which six-color (cyan, magenta, yellow, black, tinted cyan and tinted magenta) recording is effected by using fundamental four color (cyan, magenta, yellow and black) inks and tinted inks having lower densities of such color inks simultaneously, have been developed. Further, countermeasure for reduction in a recording speed due to enhancement of image quality has been made by increasing element number of the recording head and/or by enhancing driving frequency and/or by using a technique such as bi-directional recording thereby to good through-put. Further, as the high image quality and high through-put have been achieved, as means for improving reliability of the recorded image, various recovery operations (wiping, preliminary discharge, suction recovery and the like) have been carried out.

The preliminary discharge is an operation (processing) for preventing occurrence of poor discharging and density difference due to drying of discharge ports (or liquid paths communicated with such discharge ports) which are not used by discharging the ink from the recording head toward a preliminary discharge receiving portion provided in a non-recording area during the recording operation. On the basis of a timing for effecting the preliminary discharge, a recording environment, a temperature of the recording head, kind of the recording medium and/or a recording mode, preliminary discharge interval, discharge position, discharge number, discharge frequency and discharge pattern are controlled. For example, there has been proposed a technique in which, regarding a recording medium such as a normal (plain) paper in which the through-put is more preferential than the image quality, the preliminary discharge (time preliminary discharge) is effected upon recording start scanning after a predetermined time period from the previous preliminary discharge is elapsed, and, on the other hand, regarding a recording medium such as a glossy paper in which the image quality is more preferential than the through-put or depending upon the recording mode, the time interval between the time preliminary discharges is shortened or the preliminary discharge (each line preliminary discharge) is effected each time upon the recording scanning. Further, in order to reduce a moving time to the preliminary discharge receiving portion, there has been proposed a technique in which the preliminary discharge receiving portion is provided within a moving range of a carriage for the recording so that the preliminary discharge is effected during acceleration or deceleration or the preliminary discharge receiving portion is provided on a platen to reduce the moving range of the carriage.

On the other hand, as a method for increasing a recordable range of the recording medium, Japanese Patent Application Laid-open Nos. 07-009714 (1995) and 2001-054955 disclose a method in which a recording medium is made recordable upon to ends of the recording medium by providing ink collecting means at a position on a platen corresponding to an end of the recording medium in a main scanning direction. Further, Japanese Patent Application Laid-open Nos. 2000-118058 and 2000-351205 disclose a method in which the recording is realized with no margins at upper and lower ends of the recording medium by providing ink absorbing means within a platen located at a position opposed to ink discharge means or by limiting discharge ports contributing to the recording (ink discharging).

However, when the recording with no margin is effected, since the recording medium during the recording or immediately after the recording cannot be held, there is a danger that the recording medium is struck against (contacted with) the carriage (including a recording head mounted thereon) due to curl of the recording medium. Such a danger is further increased when the carriage is greatly shifted from the recording medium for the preliminary discharge (for example, when the carriage is greatly shifted from a position opposed to the plane of the recording medium to a position not opposed to the plane of the recording medium. Particularly, in the ink jet serial recording apparatus in which the recording is effected by spraying the ink against the recording medium, since moisture content is apt to be changed between front and rear surfaces of the recording medium to generate curl, such a danger is apt to occur.

To avoid this, in the conventional techniques, the kind of recording media which can be recorded with no margin was limited, or a distance (sheet distance) between the recording medium and a bottom surface of a carriage (carriage unit including a carriage and a recording head) (or a lower end of the recording head) was increased so that the recording medium is not struck against (contacted with) the carriage until the curl is increased up to some extent.

However, when the kind of recoding media is limited, the advantage (characteristic) of the ink jet recording method in which various kinds of recording media can be used is lost. Further, when the sheet distance is increased, accuracy of targeting the ink droplet against the recording medium is worsened, thereby deteriorating the quality of the recording image.

Further, if the carriage (carriage unit including the recording head) is struck against the recording medium, since not only the recording medium is damaged not to be used but also the carriage cannot be moved until the struck recording medium is removed, serious error will occur, with the result that the recording operation cannot normally been continued.

On the other hand, if it is designed so that the kind of recording media is not limited and the sheet distance is varied in dependence upon the kind of the recording medium, the arrangement will become complicated and user's operation will become troublesome, which leads to increase of cost.

SUMMARY OF THE INVENTION

The present invention is made in consideration of the above-mentioned conventional drawbacks and an object of the present invention is to provide an ink jet recording apparatus which can prevent damage of a recording medium and recording means by avoiding collision between an end of the recording medium and a carriage even if the recording medium is interfered with an opposed surface of the carriage or the recording means due to curl of the recording medium.

Another object of the present invention is to provide an ink jet recording apparatus in which an opposed surface (opposed to a recording medium) of recording means and/or a carriage is made smooth and a moving range of the carriage is limited so that the smooth surface is not out of the recording medium.

A further object of the present invention is to provide an ink jet recording apparatus which can avoid collision between an end of a recording medium and a carriage or recording means even if the recording medium is interfered with an opposed surface of the carriage or the recording means due to curl of the recording medium thereby to prevent damage of the recording medium and the recording means, by limiting a moving range of the carriage effecting the recording on the recording medium.

DETAILED DESCRIPTION OF THE PREFERRED EMBODIMENTS

Figure 1:
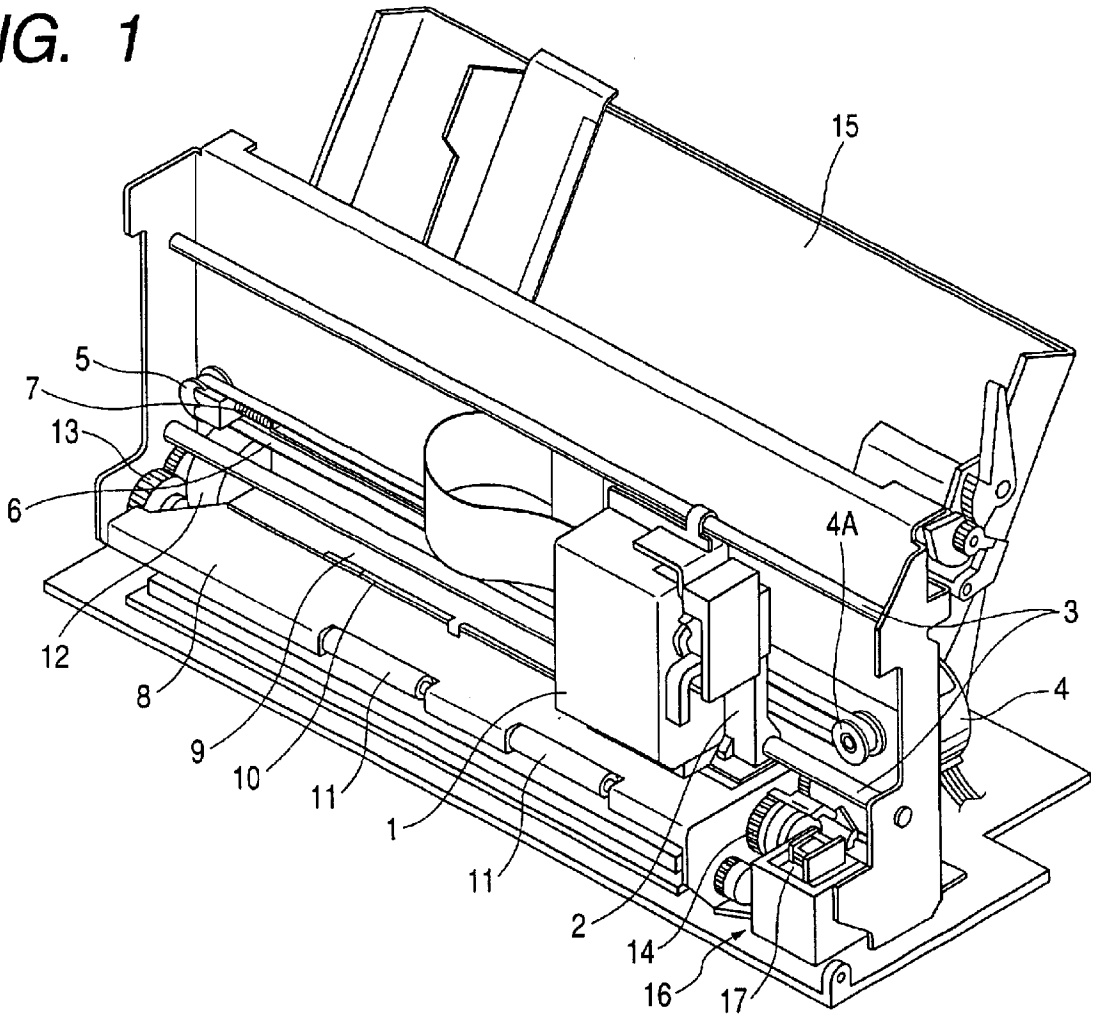
FIG. 1 is a schematic perspective view showing a schematic construction of an ink jet recording apparatus to which the present invention can suitably be applied.

The present invention will now be fully explained in connection with embodiments thereof with reference to the accompanying drawings. Incidentally, in the drawings, the same or corresponding elements are designated by the same reference numerals.

FIG. 1 is a schematic perspective view showing a schematic construction of an ink jet recording apparatus to which the present invention can suitably be applied.

The ink jet recording apparatus according to the illustrated embodiment is a recording apparatus of serial type in which recording is effected while performing main scanning along a direction perpendicular to a conveying direction (sheet feeding direction; sub scanning direction) of a recording medium and in which an image is recorded by a recording head as recording means mounted on a carriage moving (main-scanning) along the recording medium, and then, sheet feeding with a predetermined amount (pitch conveyance as sub scanning) is effected, and then, an image is recorded on the recording medium now stopped by the next main scanning of the carriage, and, by repeating such operations, the recording is effected on the entire recording medium.

In FIG. 1, an ink jet recording head (also referred to merely as "recording head" hereinafter) 1 as recording means is mounted to a carriage 2 which is guided and supported, for reciprocal movement, by two guide rails 3 provided within a main body of the apparatus. A carriage motor 4 for moving the carriage 2 is disposed at one end within the main body of the apparatus. As idler pulley 5 is disposed at the other end within the main body of the apparatus. A timing belt 6 is mounted in tension between a drive pulley 4A attached to an output shaft of the carriage motor 4 and the idler pulley 5 in parallel with the guide rails 3.

A part of the timing belt 6 is connected to the carriage 2. Further, predetermined tension is applied to the timing belt 6 by a tension spring 7 mounted for biasing the idler pulley 5. In this way, the carriage 2 is reciprocally shifted by normal and reverse rotations of the carriage motor 4, and a position and a moving speed of the carriage 2, i.e., a position and a moving speed of the recording head are controlled by a rotating amount and a rotational speed of the carriage motor 4.

At a position opposed to an ink discharge portion (discharge port face) of the recording head 1 as the recording means, there is provided a platen 8 in parallel with the guide rails 3 with a predetermined gap therebetween. The platen 8 servers to regulate a position of the recording medium such as a recording paper (print paper) at a recording position (print position) to a proper sheet distance (distance between the discharge port face and the recording medium). At an upstream side of the platen 8 in a sheet passing direction, there is provided a convey roller (feed roller or sheet feeding roller) (not shown) in parallel with the guide rails 3. By urging a pinch roller 10 supported by a pinch roller guide 9 against the feed roller, the recording medium fed out from an automatic sheet feed device 15 is conveyed to a recording portion (recording area) on the platen 8 by a friction force between the feed roller and the pinch roller 10. A convey motor (line feed motor) 12 serves to drive the feed roller (convey roller or sheet feeding roller).

In the recording portion, by driving the recording head 1 on the basis of recording information (recording data) and by effecting the scanning of the carriage in synchronous therewith, the recording is effected on the recording medium conveyed by the convey roller and the pinch roller 10.

At a downstream side of the platen 8 in the sheet passing direction, there is provided a sheet expelling roller 11 and spurs (not shown) for discharging the recording medium passed through the recording portion, and the recording medium is fed out by a friction force between the sheet expelling roller 11 and the spurs.

A convey unit 16 is disposed at a right position out of the recording area of the platen 8. The convey unit 16 is provided with a cap 17 capable of sealingly closing the ink discharge portion of the recording head 1. The recovery unit 16 is designed so that negative pressure is generated within the cap 17 by driving a suction pump communicated with the interior of the cap in a condition that the ink discharge portion is sealingly closed by the cap, with the result that ink in the discharge ports is refreshed by sucking viscosity-increased ink, solidified ink, bubbles dirt (paper powder) and the like together with the ink from the discharge ports, thereby restoring and maintaining ink discharging performance of the recording head 1.

The cap 17 is used as a sucking portion for the suction recovery operation for the recording head 1 and serves to prevent the drying of the ink in the discharge ports during the transportation of the recording apparatus and during a non-recording condition of the recording head. Further, the recovery operation for recovering the recording head 1 can also be performed by a discharging operation (preliminary discharge) for expelling (discharging) the ink from the discharge ports under pressurization, as well as the above-mentioned ink sucking operation. Furthermore, the recovery unit 16 is also provided with a wiping member (for example, such as an elastic rubber blade or an ink absorbing wipe-off member) for wiping (cleaning) foreign matters such as ink and/or dirt adhered to the discharge port face of the recording head 1.

The driving of the automatic sheet feeding device 15, convey roller (not shown), sheet expelling roller 11 and recovery unit 16 is performed through a gearing mechanism comprised of gears 13, 14 and a clutch (not shown) using the convey motor 12 as a drive source, for example. Incidentally, in the illustrated embodiment, while an example that the single recording head 1 is mounted to the carriage 2 was explained, the present invention can similarly be applied to an ink jet recording apparatus in which two or more recording heads are mounted to a carriage 2 to effect color print or gradation print.

The recording head 1 as the recording means is an ink jet recording head for discharging the ink by utilizing thermal energy and includes electrical/thermal converters for generating the thermal energy. Further, the recording head 1 serves to effect the recording by discharging the ink from the discharge port by utilizing pressure change due to growth and contraction of a bubble generated by film boiling caused in the ink by the thermal energy applied from the electrical/thermal converter. Each electrical/thermal converter is disposed within the corresponding discharge port and serves to discharge the ink from the corresponding discharge port by applying pulse voltage to the corresponding electrical/thermal converter in response to a recording signal.

Figure 2:
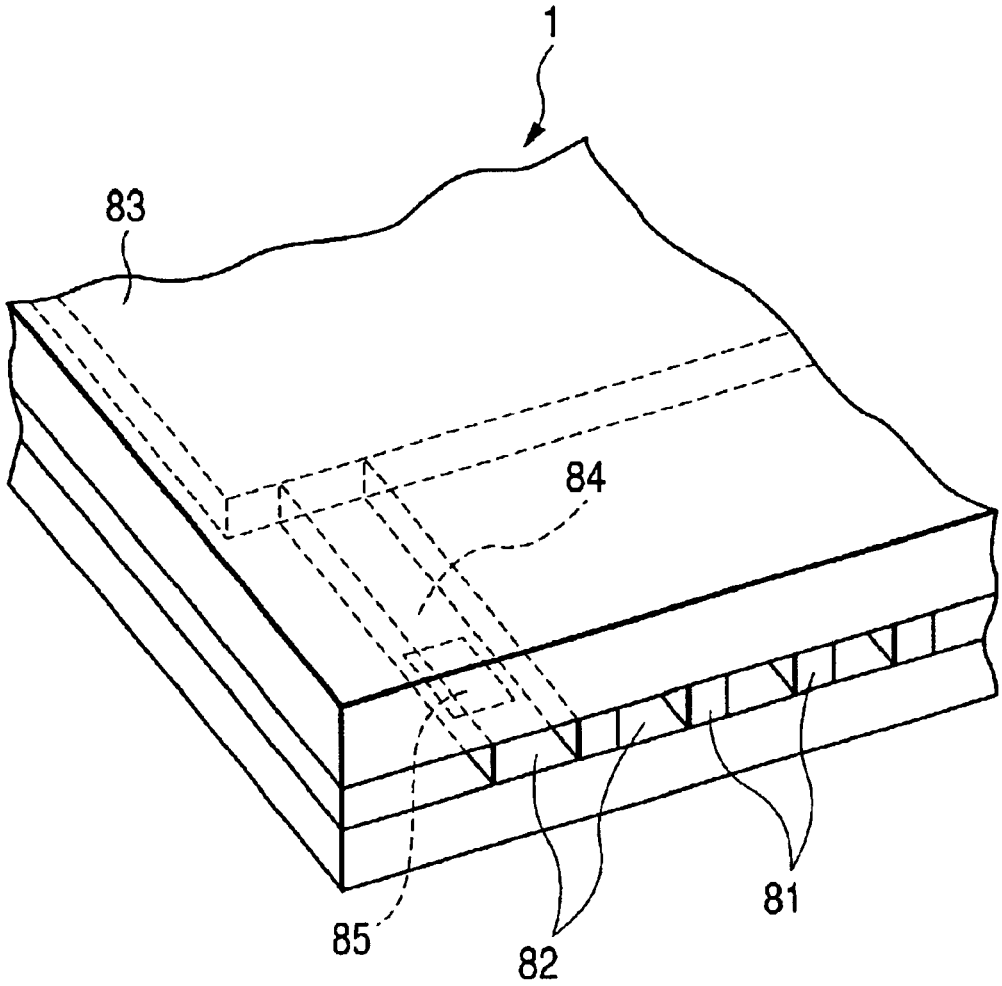
FIG. 2 is a partial perspective view schematically showing a construction of an ink discharge portion of recording means of FIG. 1.

FIG. 2 is a partial perspective view schematically showing a structure of the ink discharge portion of the recording means (recording head) 1. In FIG. 2, a plurality of discharge ports 82 are formed, with a predetermined pitch, in a discharge port face 81 opposed to the recording medium with a predetermined gap (for example, about 0.2 to 2.0 mm) therebetween, and electrical/thermal converters (heat generating bodies or heaters) 85 for generating ink discharging energy are disposed along walls of respective liquid paths 84 communicating a common liquid chamber 83 with the respective discharge ports 82. The recording head 1 is mounted to the carriage in a positional relationship than the discharge ports 82 are arranged side by side along a direction transverse to a main scanning direction (moving direction of the recording head and the carriage 2). In this way, there is provided a recording head in which the corresponding electrical/thermal converter 85 is driven (energized) in response to the image signal or discharge signal to cause the film boiling in the ink within the corresponding liquid path 84 thereby to generate the pressure by which the ink is discharged from the corresponding discharge port 82.

Now, an arrangement of a platen and preliminary discharge receiving portions of a conventional ink jet recording apparatus will be explained. Incidentally, the platen serves to guide and support the recording medium in the recording portion and the preliminary discharge receiving portion serves to receive the ink discharged (preliminary discharged) from a recording head in order to recover and maintain the ink discharging performance of the recording head.

Figure 13:
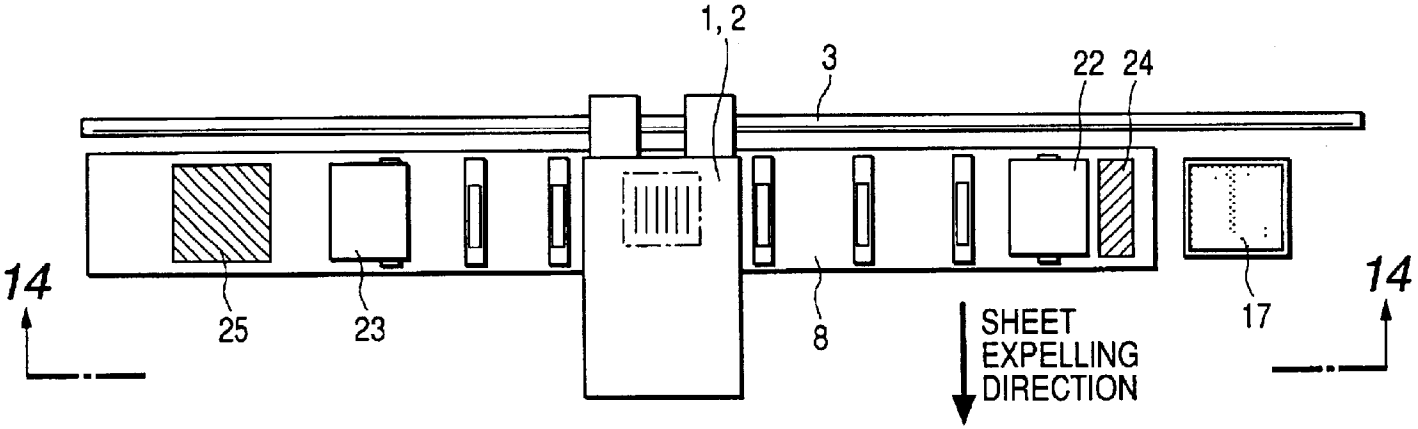
FIG. 13 is a schematic plan view showing an arrangement of a platen and preliminary discharge receiving portions in a conventional ink jet recording apparatus.
Figure 14:
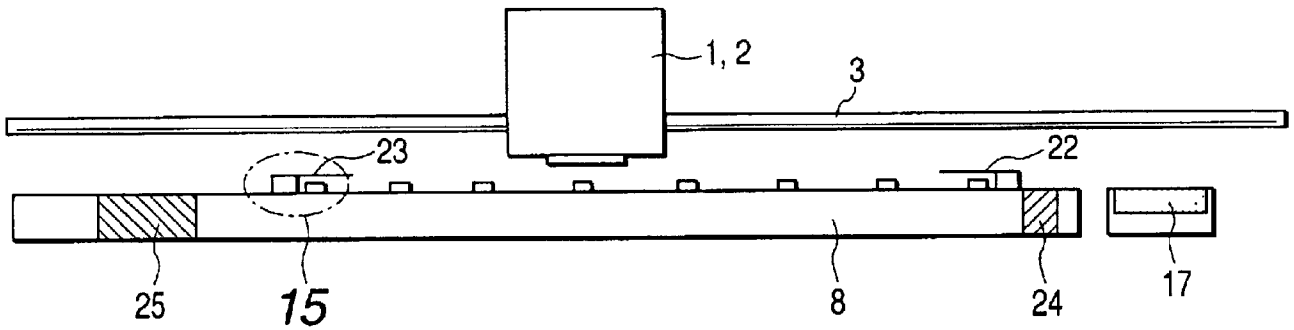
FIG. 14 is a schematic front view looked at from the line 14—14 in FIG. 13.
Figure 15:
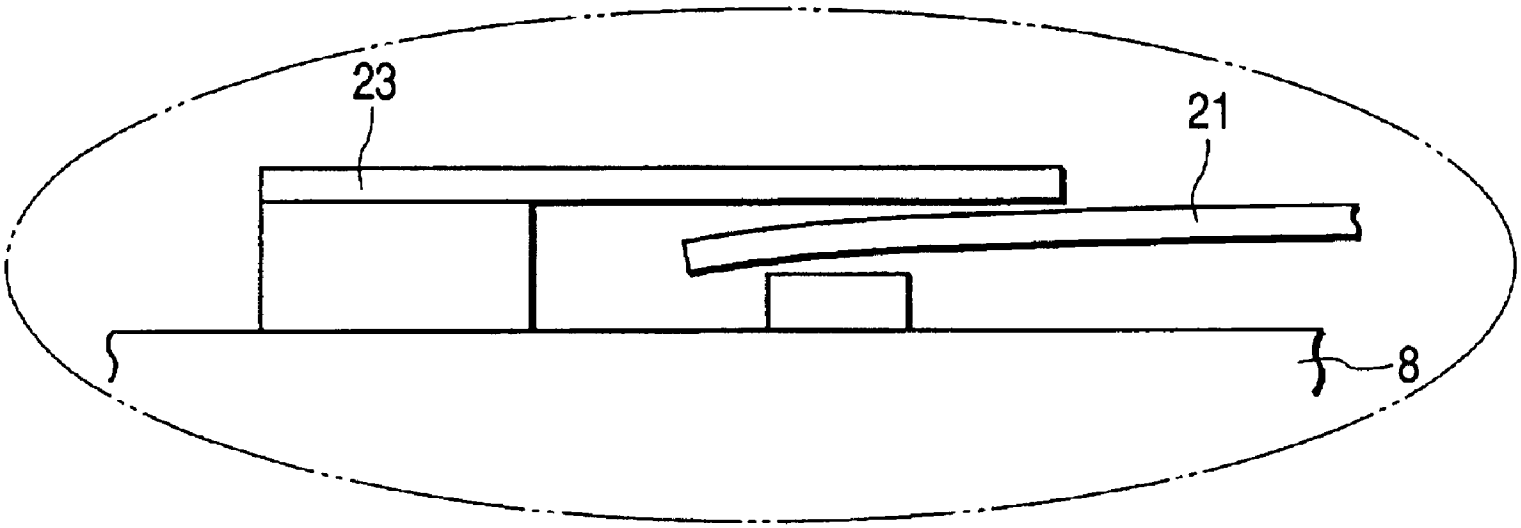
FIG. 15 is a partial enlarged front view showing a relationship between a sheet pressing plate of FIG. 14 and a recording medium in an enlarged scale.

FIG. 13 is a schematic plan view showing the arrangement of the platen and the preliminary discharge receiving portions of the conventional ink jet recording apparatus, FIG. 14 is a schematic front view looked at from the line 14—14 in FIG. 13, and FIG. 15 is a partial enlarged front view showing a relationship between a sheet pressing plate of FIG. 14 and a recording medium in an enlarged scale.

In FIGS. 13 to 15, in the conventional ink jet recording apparatus, sheet pressing plates 22, 23 for pressing or holding down both lateral edges of a recording medium 21 are provided over a platen 8 at its both end portions to suppress curls at both edges of the recording medium (such as a recording paper) 21 during the recording operation thereby to prevent the recording medium 21 from being pulled on the recording head 1 or the carriage 2. However, with this arrangement, since the recording medium 21 is covered by the sheet pressing plates 22, 23, the recording on the covered areas is impossible, thereby limiting the recordable range greatly.

And, in the illustrated example, preliminary discharge receiving portions 24, 25 are disposed at areas on the platen 8 outwardly of the sheet pressing plates 22, 23. Further, a cap 17 capable of abutting against and capping a discharge port face 51 of the recording head 1 is disposed at a predetermined position (home position of the carriage 2 set at the right side, in the illustrated example) out of the platen 8.

Figure 16:
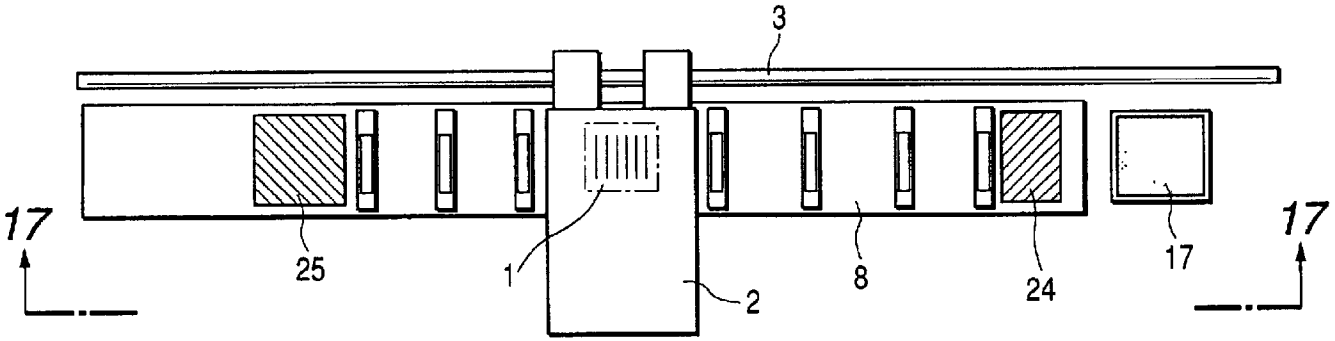
FIG. 16 is a schematic plan view showing an arrangement of a platen and preliminary discharge receiving portions in a conventional ink jet recording apparatus in which sheet pressing plates are omitted to widen a recordable range.
Figure 17:
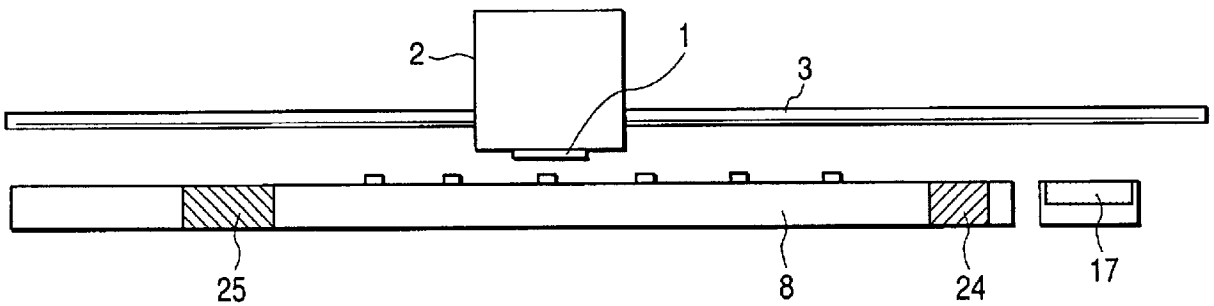
FIG. 17 is a schematic front view looked at from the line 17—17 in FIG. 16.
Figure 18:
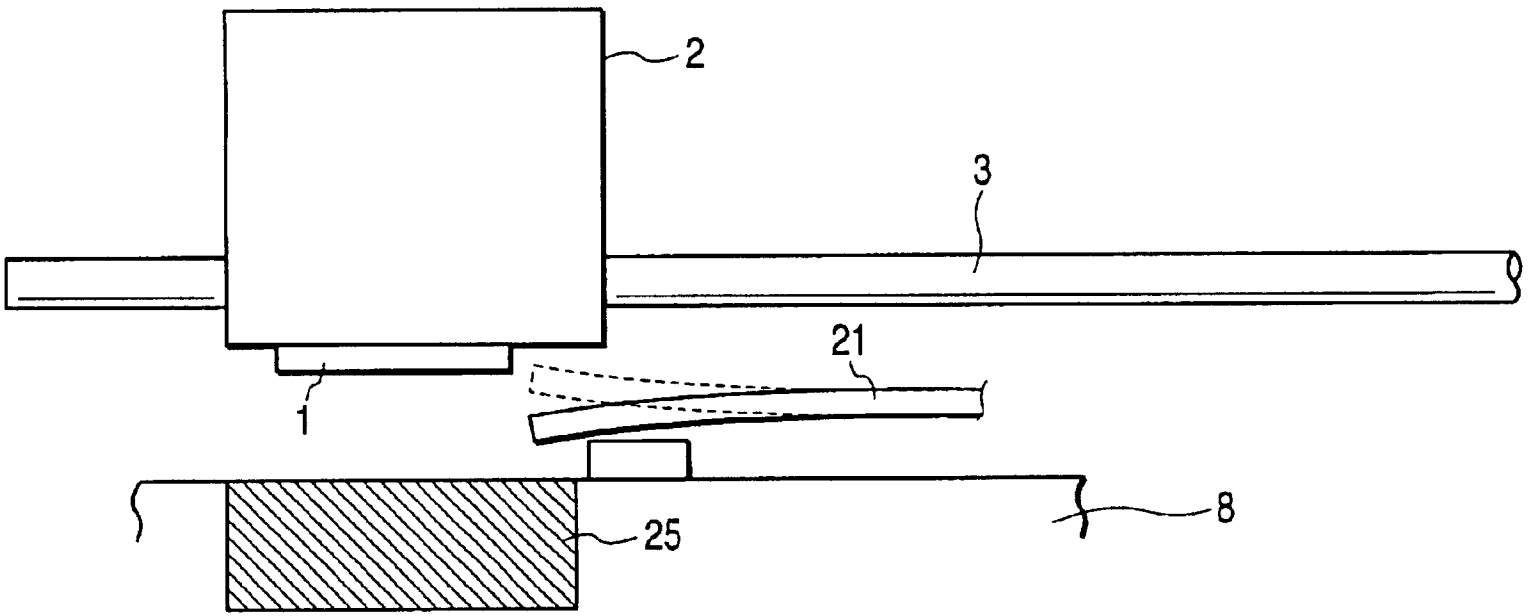
FIG. 18 is a schematic partial enlarged front view showing a condition that a left side edge of a recording medium guided and supported on the platen is interfered with a recording head and a carriage.

FIG. 16 is a schematic plan view showing an arrangement of a platen and preliminary discharge receiving portions of the conventional ink jet recording apparatus in which sheet pressing plates are omitted in order to widen the recordable range, FIG. 17 is a schematic front view looked at from the line 17—17 in FIG. 16, and FIG. 18 is a schematic partial enlarged front view showing a condition (shown by the dotted line) that a left side edge of a recording medium guided and supported on the platen is interfered with a recording head and a carriage.

As shown in FIGS. 16 to 18, in the conventional ink jet recording apparatus, when the sheet pressing plates are omitted to widen the recordable range, if the recording medium 21 is curled to interfere with the recording head 1 (the recording medium 21 is shown by the dotted line in this case in FIG. 18), as the recording head 1 is moved, the recording medium 21 will be pulled onto the recording head or the carriage, and, in such a case, if worst comes to worst, the recording head 1 and the carriage 2 will become immobile.

In order to solve such a technical problem, according to the present invention, in an ink jet recording apparatus in which the recording is effected by discharging the ink from the recording means 1 mounted to the reciprocally moving carriage 2 toward the recording medium 21, an opposed surface (opposed to the recording medium 21) of the recording head 1 or the carriage 2 is made smooth, and a moving range of the carriage 2 is limited so that the smooth portion is not out of the recording medium.

Figure 3:
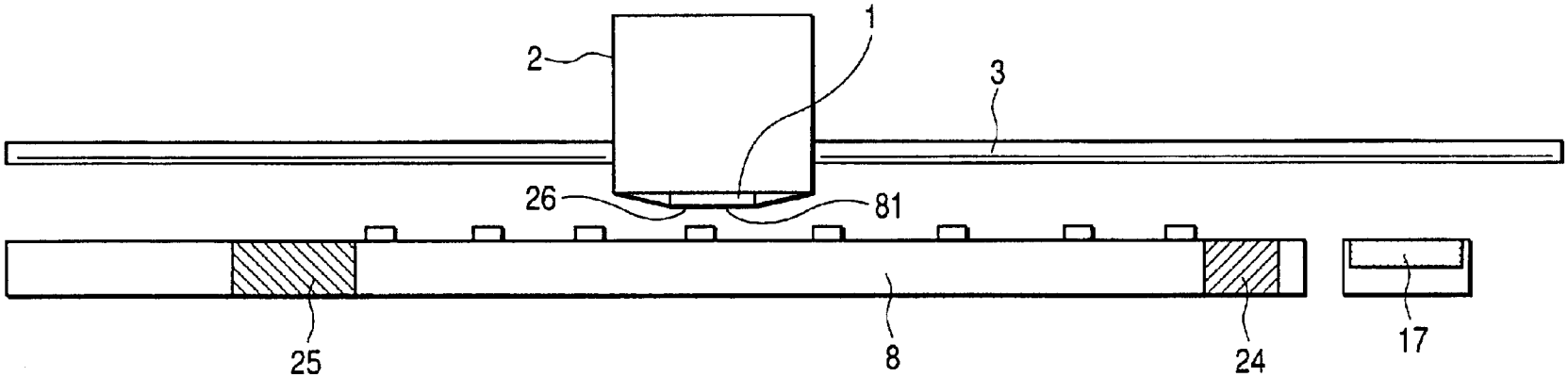
FIG. 3 is a schematic front view showing a relationship between a platen/preliminary discharge receiving portions and a carriage in an ink jet recording apparatus according to a first embodiment of the present invention.
Figure 4:
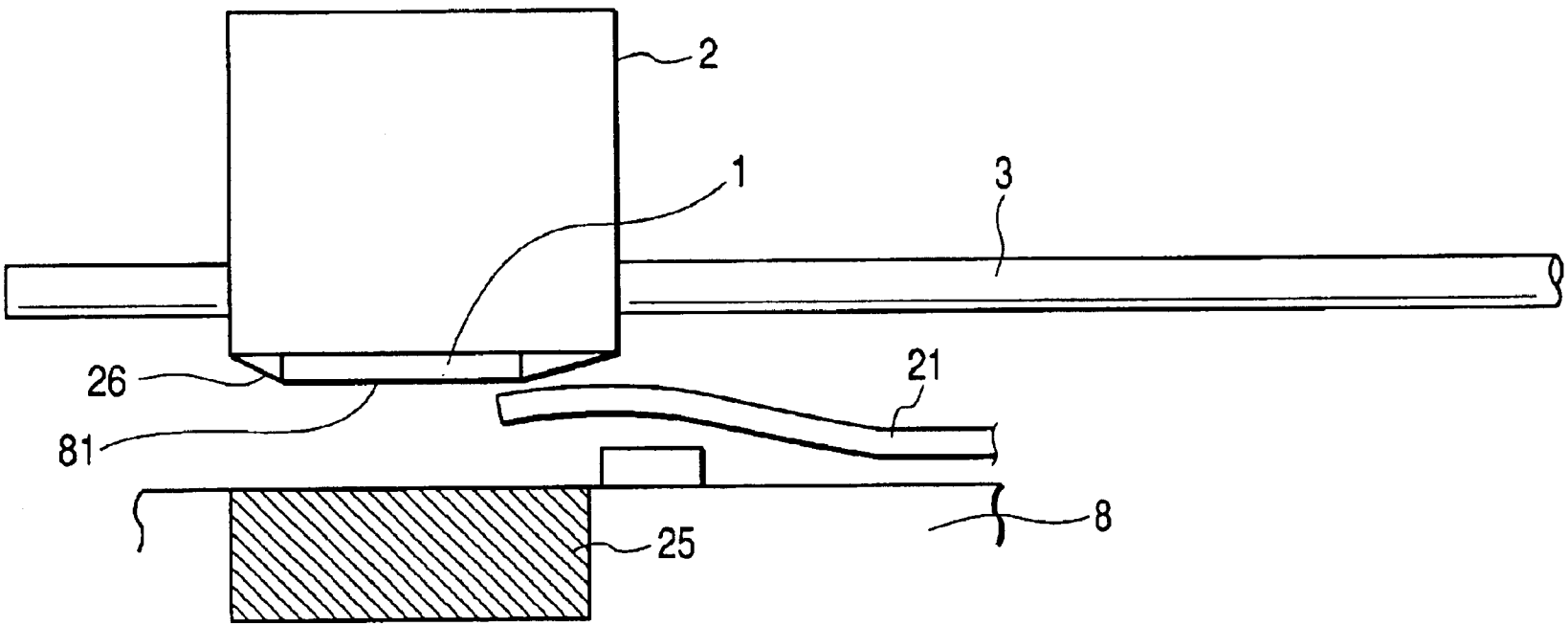
FIG. 4 is a schematic partial enlarged front view showing a condition that a left side edge of a recording medium guided and supported on the platen is interfered with a recording head and the carriage in the construction of FIG. 3.
Figure 5:
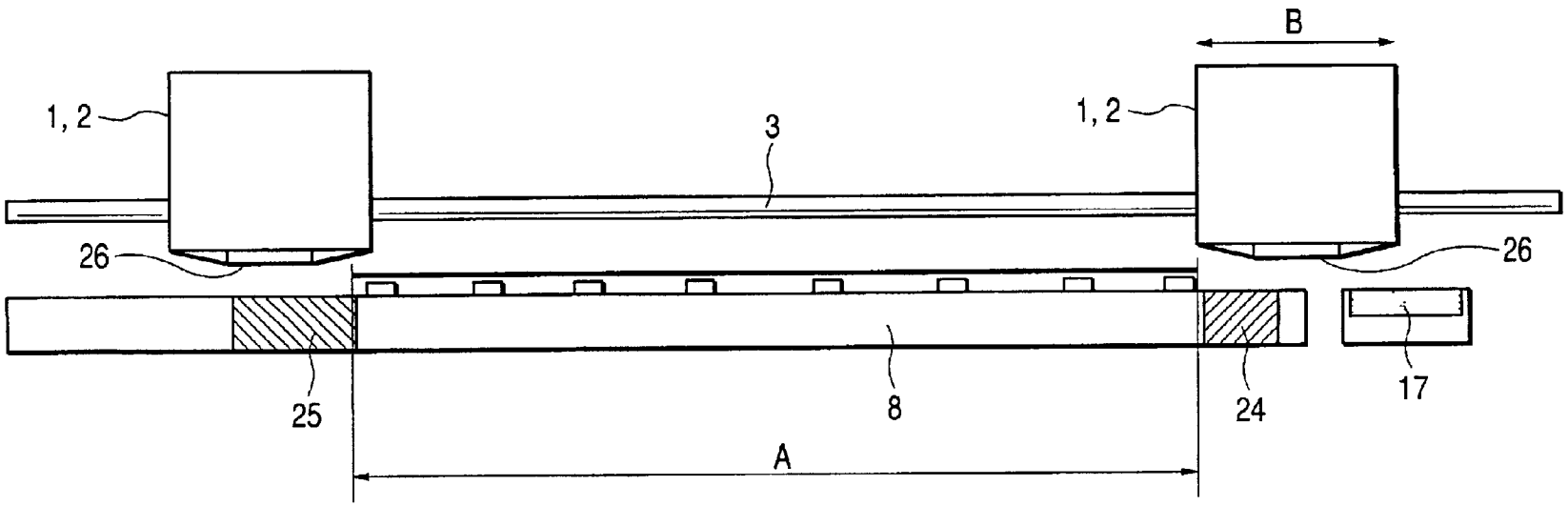
FIG. 5 is a schematic view showing a maximum moving range of the carriage in the construction of FIG. 3.

FIG. 3 is a schematic front view showing a relationship between a platen/preliminary discharge receiving portions and a carriage in an ink jet recording apparatus according to an embodiment (first embodiment) of the present invention, FIG. 4 is a schematic partial enlarged front view showing a condition that a left side edge of a recording medium 21 guided and supported on the platen 8 is interfered with a recording head 1 and the carriage 2 in the construction of FIG. 3, and FIG. 5 is a schematic view showing a maximum moving range of the carriage in the construction of FIG. 3.

In FIGS. 3 to 5, opposed surfaces (bottom surfaces, in the illustrated embodiment) of the recording head 1 and the carriage 2, which surfaces are opposed to the recording medium 21, are made smooth to form a smooth portion 26. The smooth portion 26 conceptionally means a flat surface or a curved surface with no stepped portion and practically means a surface on which an end of the recording medium 21 can be slid without obstruction even when the recording head 1 or the carriage 2 is interfered with the recording medium 21 as the carriage 2 is moved.

A moving range of the carriage 2 is limited to a range in which the smooth portion 26 cannot be moved out of the recording medium 21. That is to say, a maximum moving range (maximum moving width) of the carriage 2 in the illustrated embodiment is a length "A+B" which is the sum of a width "A" of the recording medium 21 shown in FIG. 5 and a width "B" of the smooth portion 26.

Further, in the recording head 1, there are discharge ports 82 (or liquid paths 84) which are not used when a monochromatic text is recorded by color recording heads, for example, and, recovery discharge called as preliminary discharge is effected at a predetermined timing with respect to such non-used discharge ports. The preliminary discharge is performed as the discharging operation effected out of the recording range.

In the ink jet recording apparatus to which the present invention is applied, the preliminary discharge is also performed within the moving range of the carriage 2. Namely, positions of preliminary discharge receiving portions for receiving the ink discharged from the recording head 1 during the preliminary discharge are selected within the limited moving range of the carriage 2 (and accordingly the recording head 1).

In the first embodiment shown in FIGS. 3 to 5, the recording head 1 and the carriage 2 shown on both sides in FIG. 5 indicate a start position and a finish position of one line (one scan), and the preliminary discharge receiving portions are constituted by two preliminary discharge receiving portions 24, 25 on the platen 8 at both ends thereof. That is to say, as apparent from FIG. 5, both the preliminary discharge receiving portion 24 on the platen at a home position side and the preliminary discharge receiving portion 25 on the platen at a non-home position side (opposite to the home position) can be used, and these preliminary discharge receiving portions 24, 25 are disposed within the moving range of the carriage 2.

Incidentally, in the ink jet recording apparatus, depending upon constructions of a conveying mechanism and a holding mechanism for the recording medium, the recording medium is apt to be curled only for a predetermined time period after the starting of the recording or the finishing of the recording. In such a case, the present invention may be applied only in such time period (apt to be curled) to control to limit the moving range of the carriage.

For example, in a case where there are provided holding mechanisms (recording medium abutting and holding means) for pressing down left and right edges of the recording medium at both sides of the platen 8 in the moving direction of the carriage, the present invention may be applied only when the recording medium is held by either of the holding mechanisms, and, when the recording medium is held by both holding mechanism, since the curl of the recording medium is little, and thus, the moving range of the recording head 1 (carriage 2) may not be limited. In this case, the time during which the present invention is applied is short, and, if the preliminary discharge is not effected on the way, the preliminary discharge receiving portions are not necessarily provided within the moving range of the carriage 2.

Figure 6:
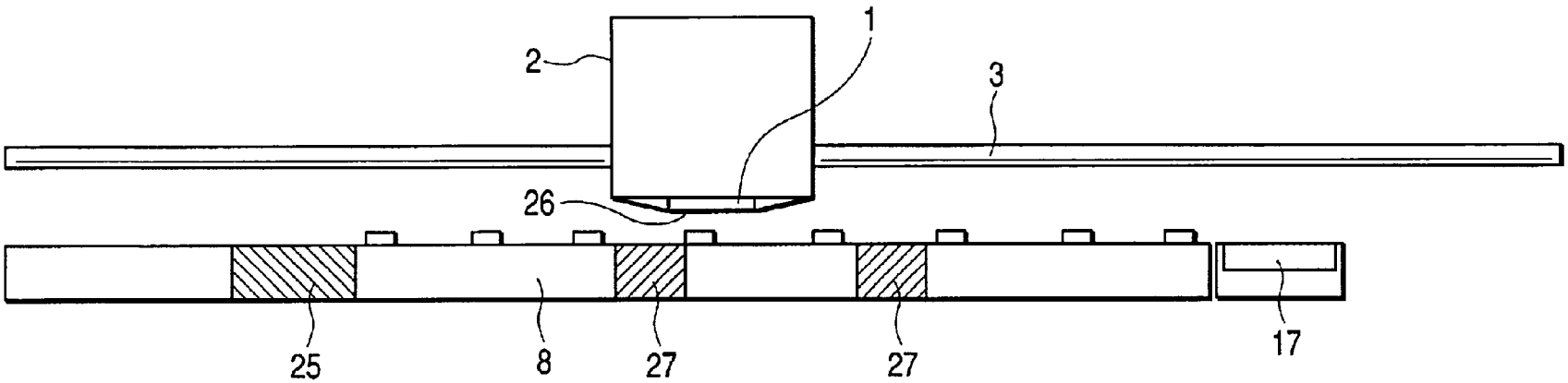
FIG. 6 is a schematic front view showing a relationship between a platen/preliminary discharge receiving portions and a carriage in an ink jet recording apparatus according to a second embodiment of the present invention.
Figure 7:
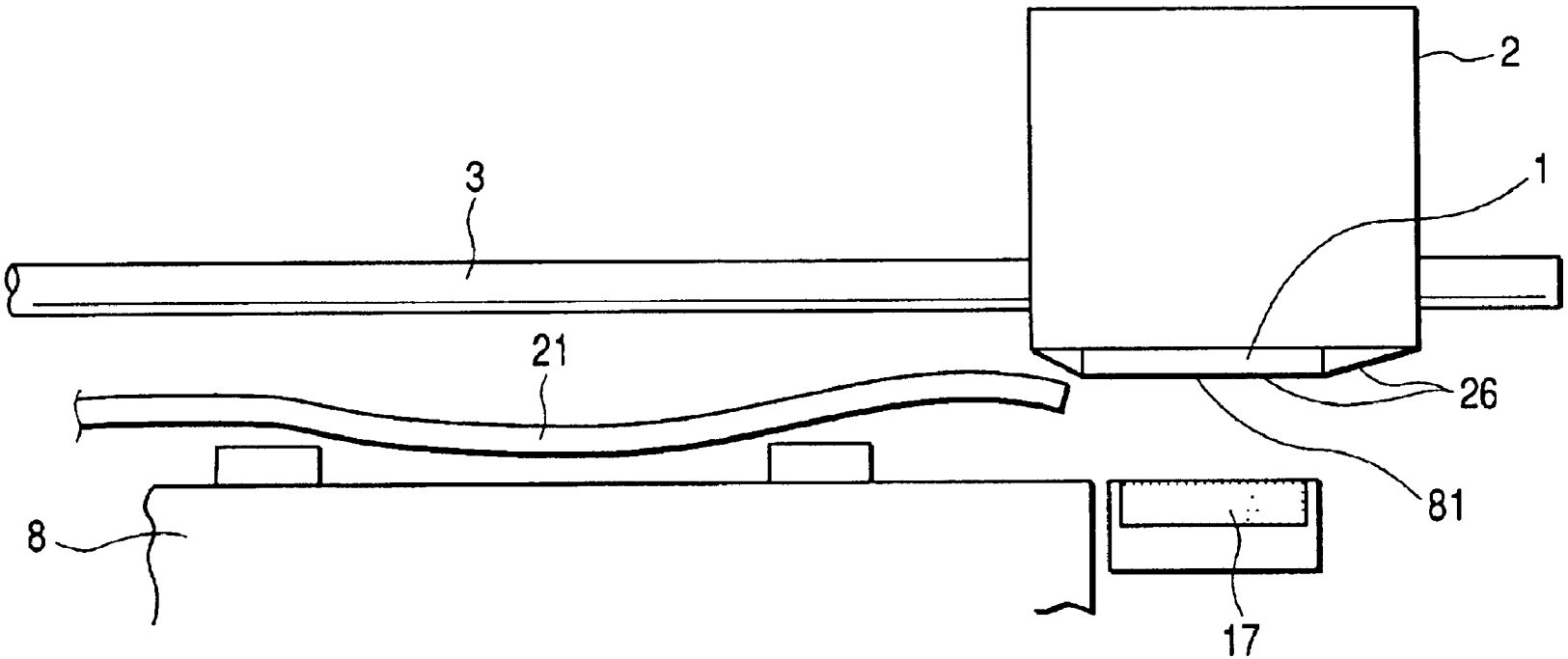
FIG. 7 is a schematic partial enlarged front view showing a condition that a cap disposed out of the platen is utilized as a preliminary discharge receiving portion in the construction of FIG. 6.

FIG. 6 is a schematic front view showing a relationship between a platen/preliminary discharge receiving portions and a carriage in an ink jet recording apparatus according to another embodiment (second embodiment) of the present invention, and FIG. 7 is a schematic partial enlarged front view showing a condition that a cap 17 disposed at a position (normally, home position) out of the platen 8 is utilized as a preliminary discharge receiving portion in the construction of FIG. 6.

In FIGS. 6 and 7, according to the second embodiment, on the platen 8, there are provided plural (two) preliminary discharge receiving portions 27 on the platen corresponding to plural recording media (having different width dimensions), in addition to a preliminary discharge receiving portion 25 on the platen at a non-home position side. These preliminary discharge receiving portions 27 can also act as no margin recording ink receiving portions provided for the recording of various size recording media with no margin.

Further, at a home position side, a cap 17 used for protection of the recording head 1 and the suction recovery processing also acts as a preliminary discharge receiving portion at the home position side. To this end, in the illustrated embodiment, the cap 17 is disposed within the moving range of the carriage according to the present invention. Namely, when the preliminary discharge is performed at the preliminary discharge receiving portion at the home position side (including the cap 17) during the recording operation, as shown in FIG. 7, even in a condition that the carriage 2 (recording head 1) is shifted to a position opposed to the cap 17 (for example, a condition that the carriage is shifted to the maximum extent), the smooth surface 26 formed on the opposed surfaces (opposed to the recording medium 21) of the recording head 1 and the carriage 2 is not shifted out of the recording medium 21 (space above the recording medium 21).

In other words, in the second embodiment shown in FIGS. 6 and 7, since the cap 17 is disposed adjacent to the platen 8 as shown, at the home position side, even when there is no addition preliminary discharge receiving portion, the recording medium 21 can positively be prevented from being pulled on the recording head and the preliminary discharge can be effected within the moving range of the carriage.

Figure 8:
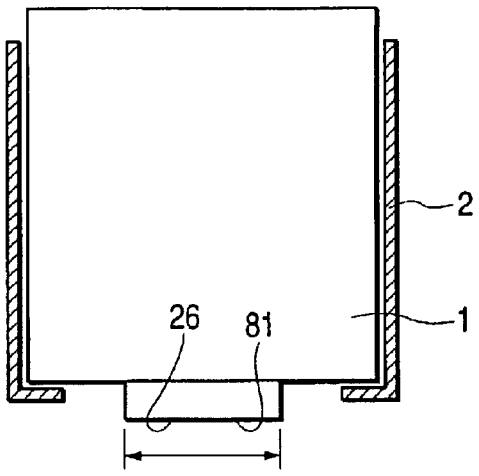
FIG. 8 is a schematic longitudinal sectional view showing a condition that a smooth portion formed on an opposed surface (opposed to a recording medium) of recording means and a carriage is formed only at a discharge port face of the recording means in an ink jet recording apparatus to which the present invention applied.
Figure 9:
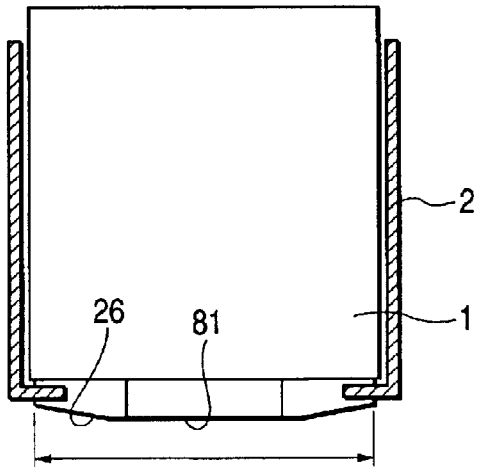
FIG. 9 is a schematic longitudinal sectional view showing a condition that a smooth portion formed on an opposed surface (opposed to a recording medium) of recording means and a carriage is formed in an entire end surface including a discharge port face of the recording means in an ink jet recording apparatus to which the present invention is applied.
Figure 10:
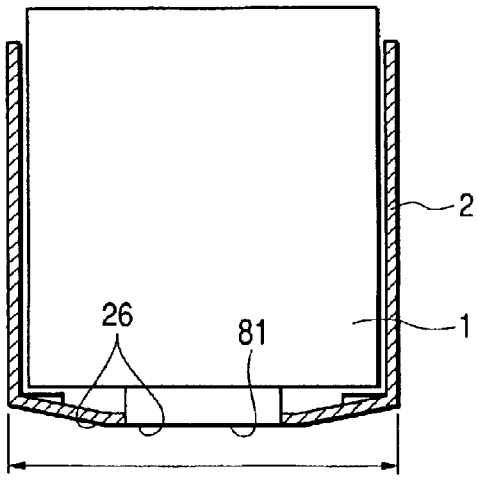
FIG. 10 is a schematic longitudinal sectional view showing a condition that a smooth portion formed on an opposed surface (opposed to a recording medium) of recording means and a carriage is formed at a discharge port face of the recording means and at an end surface of the carriage in an ink jet recording apparatus to which the present invention is applied.

FIGS. 8 to 10 are schematic longitudinal sectional views showing various smooth portions each formed on the opposed surface (opposed to the recording medium 21) of the recording head (recording means) 1 or the carriage 2 of the ink jet recording apparatus to which the present invention is applied.

FIG. 8 shows a case where the smooth portion 26 is limited to a range of the discharge port face (face surface) 81 of the recording head 1, FIG. 9 shows a case where the smooth surface 26 is formed by smoothing the entire tip end surface (bottom surface, in the illustrated embodiment) including the discharge port face 81 of the recording head 1, and FIG. 10 shows a case where the smooth surface 26 is formed by entirely smoothing the discharge port face 81 of the recording head 1 and the tip end surface (bottom surface, in the illustrated embodiment) of the carriage 2. In this way, in the present invention, such various smooth surfaces 26 can be used. Incidentally, each of the double-headed arrows shown in FIGS. 8 to 10 indicates a range of the smooth surface 26.

Figure 11:
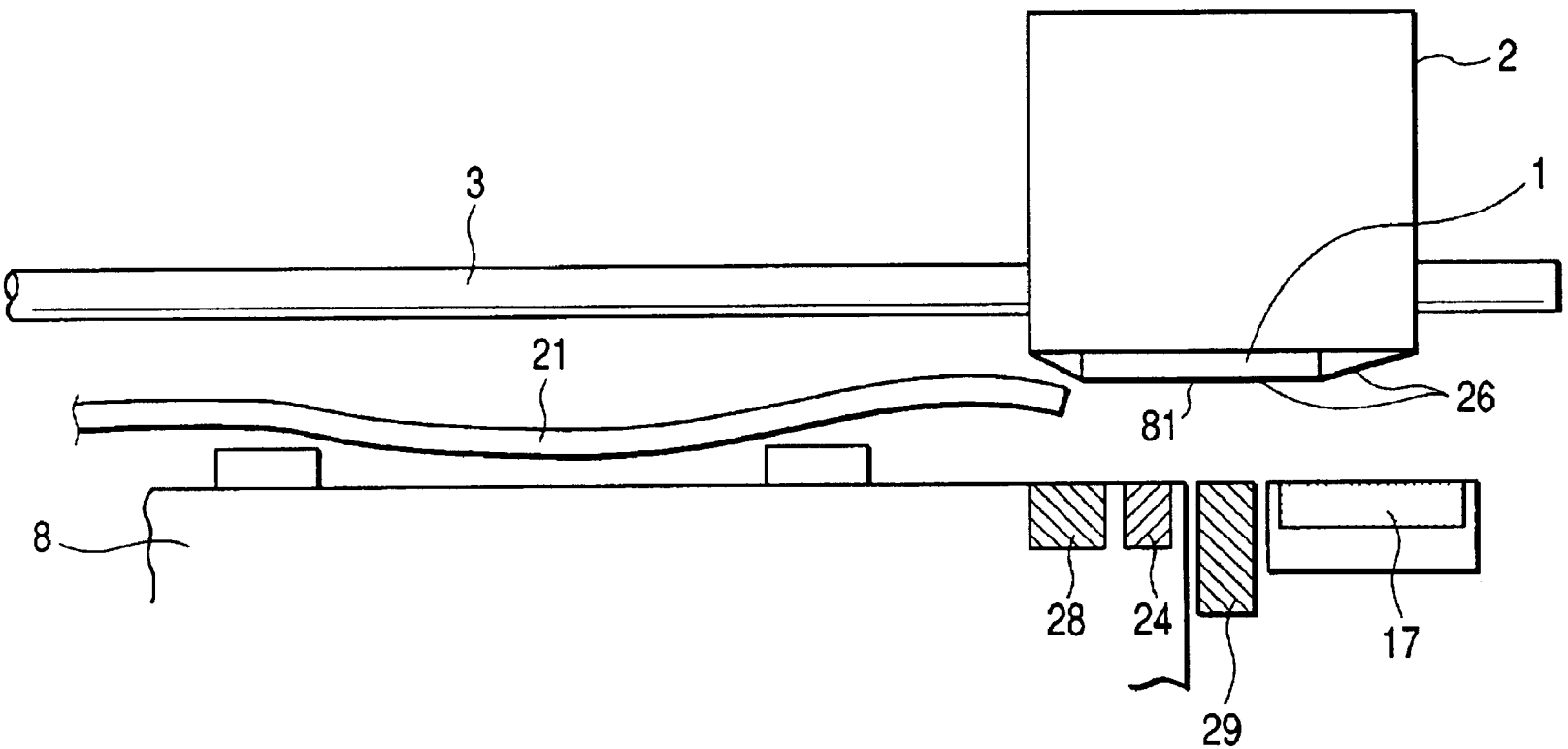
FIG. 11 is a schematic partial front view of a platen and a carriage, showing an example an arrangement of various preliminary discharge receiving portion at a home position of a moving area of the carriage in an ink jet recording apparatus to which the present invention is applied.

FIG. 11 is a schematic partial front view of a platen and a carriage, showing an arrangement of various preliminary discharge receiving portions at the home position side in the ink jet recording apparatus to which the present invention is applied.

As shown in FIG. 11, regarding the preliminary discharge receiving portion at the home position side in the ink jet recording apparatus to which the present invention is applied, the preliminary discharge receiving portion utilizing no margin recording ink absorbing port (ink receiving portion) 28 provided in the platen 8 can be used, or the preliminary discharge receiving portion 24 on the platen provided on the recording platen 8 can be used, or the preliminary discharge receiving portion 29 provided adjacent to the platen 8 can be used, or the preliminary discharge can be effected within the cap 17 for covering the discharge ports of the recording head 1, or any combination thereof can be used.

Figure 12:
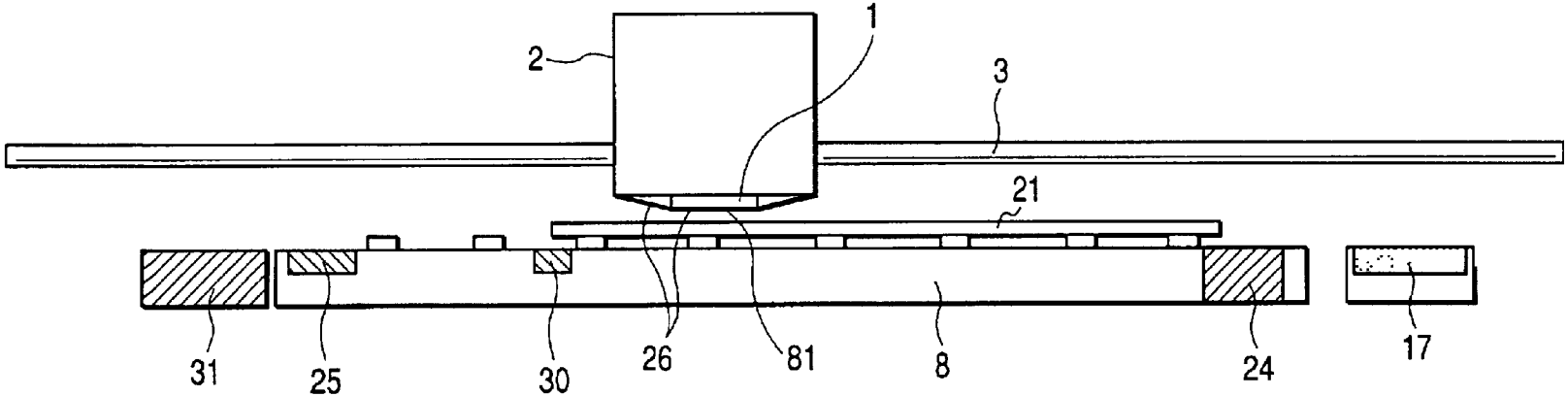
FIG. 12 is a schematic partial front view of a platen and a carriage, showing an example an arrangement of various preliminary discharge receiving portion at a position (non-home position) opposite to a home position of a moving area of the carriage in an ink jet recording apparatus to which the present invention is applied.

FIG. 12 is a schematic partial front view of a platen and a carriage, showing an arrangement of various preliminary discharge receiving portions at the non-home position side (opposite to the home position) in the ink jet recording apparatus to which the present invention is applied.

As shown in FIG. 12, also regarding the preliminary discharge receiving portion at the non-home position side in the ink jet recording apparatus to which the present invention is applied, the preliminary discharge receiving portion utilizing no margin recording ink absorbing port (ink receiving portion) 30 provided in the platen 8 can be used, or the preliminary discharge receiving portion 25 on the platen provided on the recording platen 8 can be used, or the preliminary discharge receiving portion 31 at the non-home position side provided adjacent to the platen 8 can be used, or any combination thereof can be used.

Incidentally, although the home position side is shown in FIG. 11 and the non-home position side (opposite to the home position side) is shown in FIG. 12, any number of preliminary discharge receiving portions appropriately selected from the home position side and the non-home position side may be used in combination.

That is to say, in the present invention, one or more preliminary discharge receiving portions can be appropriately be selected from the preliminary discharge receiving portions at the home position side shown in FIG. 11 and the preliminary discharge receiving portions at the non-home position side shown in FIG. 12, and the selected preliminary discharge receiving portions can be positioned within the moving range of the carriage 2.

Accordingly, the present invention can be carried out with all combinations of the preliminary discharge receiving portions (including the portion also acting as the cap), including what kind of preliminary discharge receiving portions are arranged at the home position side and the non-home position side and at which side the preliminary discharge receiving portions are arranged, and all of such combinations are included in the scope of the present invention.

Further, when it is desired to carry out the present invention under a condition that it is difficult to provide a plurality of preliminary discharge receiving portions on the platen 8, it is effective that the preliminary discharge receiving portions are provided only at a recording medium abutting side (normally, a side of a recording medium holding mechanism disposed near the home position) for regulating the position of the recording medium 21. A most simple method is to effect one direction recording (one-way recording) and to use only the preliminary discharge receiving portions at the home position side, since the preliminary discharge is performed immediately before the recording scanning.

Further, it is also effective that execution (application) of the present invention is determined on the basis of judgement regarding good/bad of the recording quality of the recording medium 21 or judgement whether normal recording or no margin recording is effected. For example, when the ink use amount is little or when the recording medium itself is hard to be curled, the present invention is not executed, whereas, when a recording medium apt to be curled is used or when the recording quality may be deteriorated or when no margin recording (recording with no margin) is effected, the present invention may be carried out (applied).

According to the above-mentioned embodiment, in the ink jet recording apparatus in which the recording is effected by discharging the ink toward the recording medium 21 from the recording head 1 mounted to the reciprocally moving carriage 2, the opposed surface (opposed to the recording medium) of the recording means and/or the carriage is made smooth, and there is provided the regulating means for regulating or limiting the moving range (A+B) of the carriage 2 so that the smooth portion 26 is not shifted out of the recording medium 21.

The smooth portion 26 may be formed only on the discharge port face 81 of the recording means 1 or may be formed on the entire surface including the discharge port face 81 of the recording means 1 and the opposed surface (bottom surface as shown) (opposed to the recording medium 21) of the recording means or may be formed on the entire surface (entire bottom surface as shown) comprised of the discharge port face 81 of the recording means 1 and the opposed surface (opposed to the recording medium 21) of the carriage 2.

The moving range of the carriage 2 is set to be smaller than the sum of the width A of the recording medium 21 and the width B of the smooth portion 26.

Further, in the above-mentioned embodiments, the preliminary discharge receiving portions for receiving the ink preliminary discharged to recover the recording head 1 are disposed within the moving range (A+B) of the carriage 2.

The preliminary discharge portion may be the receiving portion (preliminary discharge receiving portion at the home position side) 29 provided at the home position side or may be the receiving portion also acting at the cap 17 provided at the home position side or may be the receiving portion (preliminary discharge receiving portion on the platen at the home position side) 24 provided on the platen at the home position side or may be the no margin recording ink receiving portion (no margin recording ink absorbing port at the home position side) 28 provided on the platen at the home position side. Further, any combination of these portions may be used as the preliminary discharge receiving portions.

Further, the preliminary discharge portion may be the receiving portion (preliminary discharge receiving portion at the non-home position side) 31 provided at the non-home position side (opposite to the home position) or may be the receiving portion (preliminary discharge receiving portion on the platen at the non-home position side) 25 provided on the platen at the position opposite to the home position side or may be the no margin recording ink receiving portion (no margin recording ink absorbing port at the non-home position side) provided on the platen at the position opposite to the home position side. Further, any combination of these portions may be used as the preliminary discharge receiving portions.

Further, the preliminary discharge receiving portions at the home position side and the preliminary discharge receiving portions at the non-home position side may be combined appropriately.

Furthermore, in the above-mentioned embodiments, there is provided control means for regulating or limiting the moving range of the carriage 2 to (A+B) when it is judged that the recording medium 21 may be curled.

In this case, as judging means for judging occurrence of curl of the recording medium 21, there is disclosed means for judging the curl on the basis of at least one of the kind of the recording medium, quality of the recorded image and presence/absence of margin of the recording medium.

Further, an arrangement in which the limitation of the moving range of the carriage 2 is effected during the recording is effected on the recording medium on the basis of the recording data (i.e., during the recording operation) is also disclosed.

In addition, it is designed to limit the moving range of the carriage 2 while the recording medium is abutting against and is being supported by recording medium regulating means (holding mechanism for holding one edge of the recording medium) at either side on the platen 8.

Furthermore, an arrangement in which one direction recording (one-way recoding) is used in order to limit the moving range of the carriage 2 is also disclosed.

Further, an arrangement in which the positions of the preliminary discharge receiving portions are limited to the recording medium abutting side (side of the holding mechanism for regulating the position of the edge of the recording medium 21) in order to limit the moving range of the carriage 2 is also disclosed.

According to the above-mentioned embodiments, even if the recording medium 21 is interfered with the opposed surface (bottom surface as shown) of the carriage 2 or the recording means (recording head) 1 due to the curl of the recording medium, as shown in FIG. 4, collision between the edge of the recording medium 21 and the carriage 2 and the squeezing can be avoided, and the carriage 2 can be slid relative to the recording medium 21 without catching, and the damage of the recording medium and the recording means can be prevented.

Incidentally, in the above-mentioned embodiments, while an example that the single recording head is used in the ink jet recording apparatus was explained, the present invention can similarly be applied to an ink jet recording apparatus in which plural different color inks are discharged by using one or more recording heads and a gradation recording ink jet recording apparatus in which plural inks having the same color and different densities are used and an ink jet recording apparatus obtained by a combination thereof, and the same technical effects can be achieved.

Further, the present invention can similarly be applied to arrangements in which recording means such as a recording head and an ink reservoir portion such as an ink tank are arranged in various ways, such as an arrangement using an exchangeable ink jet cartridge obtained by integrally combining a recording head as recording means and an ink tank as an ink reservoir portion and an arrangement in which the recording means and the ink reservoir portion are separately provided and these are interconnected via an ink supplying tube and the like, and the same technical effects can be achieved.

Incidentally, in the above-mentioned embodiments, while an example that the single recording head 1 as the recording means is mounted to the carriage 2 for the recording was explained, the present invention can similarly be applied regardless of the number of the recording heads and regardless of the number of discharge port arrays provided in the same discharge port face, and the present invention can similarly be applied to a color ink jet recording apparatus in which the recording is effected with plural different colors by using one or more recording heads or a gradation recording ink jet recording apparatus in which the recording is effected with the same color and different densities or an ink jet recording apparatus obtained by a combination thereof, and the same technical effects can be achieved.

Further, the present invention can similarly be applied to arrangements in which the recording head and the ink tank are arranged in various ways, such as an arrangement using the exchangeable ink jet cartridge obtained by integrally combining the recording head and the ink tank and an arrangement using recording means in which the ink tank is detachably mounted to the recording head, an arrangement in which the recording head and the ink tank are separately provided and these are interconnected via the ink supplying tube and the like and an arrangement using the recording head utilizing electrical/thermal converters such as piezoelectric elements, and the same technical effects can be achieved.

As apparent from the above-mentioned explanation, according to the illustrated embodiments, since the opposed surfaces (opposed to the recording medium) of the recording means and/or the carriage are made smooth and there is provided the regulating means for regulating the moving range of the carriage so that the smooth portion is not moved out of the recording medium, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing.

Further, since the smooth portion is formed only at the discharge port face of the recording means or formed at the discharge port face of the recording means and the opposed surface (opposed to the recording medium) of the recording means or formed at the discharge port face of the recording means and the opposed surface (opposed to the recording medium) of the carriage, or since the moving range of the carriage is smaller than the sum of the width of the recording medium and the width of the smooth surface, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by effectively avoiding the collision between the edge of the recording medium and the carriage and the squeezing.

Further, since the opposed surfaces (opposed to the recording medium) of the recording means and/or the carriage are made smooth and there are provided the regulating means for regulating the moving range of the carriage so that the smooth portion is not moved out of the recording medium and the preliminary discharge receiving portion disposed within the moving range of the carriage regulated by the regulating means and adapted to receive the ink preliminarily discharged to recover the recording means, there can be proposed an ink jet recording apparatus in which, even if the recording medium is interfered with the opposed surfaces (opposed to the recording medium) of the carriage or the recording means due to the curl of the recording medium, the damage of the recording medium and the recording means can be prevented by avoiding the collision between the edge of the recording medium and the carriage and the squeezing, and the preliminary discharge for recovering the recording head can be performed properly.

Further, since the preliminary discharge receiving portion is constituted by the receiving portion disposed at the home position side or the receiving portion disposed on the platen at the home position side or the no margin recording ink receiving portion disposed on the platen at the home position side or the portion disposed at the side opposite to the home position side or the receiving portion disposed on the platen at the side opposite to the home position side or the no margin recording ink receiving portion disposed on the platen at the side opposite to the home position side, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing, and the preliminary discharge for recovering the recording head can properly be performed more efficiently.

Further, since the opposed surfaces (opposed to the recording medium) of the recording means and/or the carriage are made smooth and there are provided the judging means for judging the occurrence of the curl of the recording medium and the regulating means for regulating the moving range of the carriage so that the smooth portion is not moved out of the recording medium when the judging means judges that the curl occurs in the recording medium, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing more efficiently.

Further, since the opposed surfaces (opposed to the recording medium) of the recording means and/or the carriage are made smooth and there are provided the judging means for judging the occurrence of the curl of the recording medium and the regulating means for regulating the moving range of the carriage so that the smooth portion is not moved out of the recording medium when the judging means judges that the curl occurs in the recording medium and the preliminary discharge receiving portion disposed within the moving range of the carriage regulated by the regulating means and adapted to receive the ink preliminarily discharged to recover the recording means, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing more efficiently, and the preliminary discharge for recovering the recording head can be performed properly.

Further, since the judging means judges the occurrence of the curl on the basis of at least one of the kind of the recording medium, the quality of the recorded image and presence/absence of the margin of the recording medium, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing more efficiently.

Lastly, since there is provided the arrangement in which the moving range of the carriage is regulated or limited during the recording operation or the arrangement in which the moving range of the carriage is limited when the recording medium is abutting against and supported by the recording medium regulating means disposed at either side of the platen or the arrangement in which the one direction recording is used to limit the moving range of the carriage or the arrangement in which the position of the preliminary discharge receiving portion is limited to the recording medium abutting side, there can be proposed an ink jet recording apparatus in which, even if the recording medium is interfered with the opposed surface (opposed to the recording medium) of the carriage or the recording means due to the curl of the recording medium, the damage of the recording medium and the recording means can be prevented by avoiding the collision between the edge of the recording medium and the carriage and the squeezing more efficiently.

What is claimed is:

1. An ink jet recording apparatus for effecting recording by discharging ink from recording means mounted to a reciprocally moving carriage toward a recording medium, wherein an opposed surface, opposed to said recording medium, of said recording means and/or said carriage is made smooth to form a smooth portion, said ink jet recording apparatus comprising:

regulating means for limiting a moving range of said carriage so that said smooth portion is not moved out of said recording medium.

2. The ink jet recording apparatus according to claim 1, wherein said smooth portion is formed only at a discharge port face of said recording means.

3. The ink jet recording apparatus according to claim 1, wherein said smooth portion is formed at a discharge port face of said recording means and said opposed surface, opposed to said recording medium, of said recording means.

4. The ink jet recording apparatus according to claim 1, wherein said smooth portion is formed at a discharge port face of said recording means and said opposed surface, opposed to said recording medium, of said carriage.

5. The ink jet recording apparatus according to claim 1, wherein said moving range of said carriage is smaller than a sum of a width of said recording medium and a width of said smooth portion.

6. The ink jet recording apparatus according to claim 1, wherein said moving range of said carriage is limited during a recording operation.

7. The ink jet recording apparatus according to claim 1, wherein said moving range of said carriage is limited when said recording medium is abutting against and supported by recording medium regulating means disposed at either side on a platen.

8. The ink jet recording apparatus according to claim 1, wherein one direction recording is effected to limit said moving range of said carriage.

9. The ink jet recording apparatus according to claim 1, wherein a position of a preliminary discharge receiving portion is limited to a recording medium abutting side to limit said moving range of said carriage.

10. An ink jet recording apparatus for effecting recording by discharging ink from recording means mounted to a reciprocally moving carriage toward a recoding medium, wherein an opposed surface, opposed to said recording medium, of said recording means and/or said carriage is made smooth to form a smooth portion, said ink jet recording apparatus comprising:

regulating means for limiting a moving range of said carriage so that said smooth portion is not moved out of said recording medium; and a preliminary discharge receiving portion disposed within said moving range of said carriage limited by said regulating means and adapted to receive ink preliminary discharged to recover said recording means.

11. The ink jet recording apparatus according to claim 10, wherein said preliminary discharge receiving portion is constituted by a receiving portion disposed at a home position side.

12. The ink jet recording apparatus according to claim 10, wherein said preliminary discharge receiving portion is constituted by a cap disposed at a home position side.

13. The ink jet recording apparatus according to claim 10, wherein said preliminary discharge receiving portion is constituted by a receiving portion disposed on a platen at a home position side.

14. The ink jet recording apparatus according to claim 10, wherein said preliminary discharge receiving portion is constituted by a no margin recording ink receiving portion disposed on a platen at a home position side.

15. The ink jet recording apparatus according to claim 10, wherein said preliminary discharge receiving portion is constituted by a receiving portion disposed at a side opposite to a home position side.

16. The ink jet recording apparatus according to claim 10, wherein said preliminary discharge receiving portion is constituted by a receiving portion disposed on a platen at a side opposite to a home position side.

17. The ink jet recording apparatus according to claim 10, wherein said preliminary discharge receiving portion is constituted by a no margin recording ink receiving portion disposed on a platen at a side opposite to a home position side.

18. An ink jet recording apparatus for effecting recording by discharging ink from recording means mounted to a reciprocally moving carriage toward a recording medium, wherein an opposed surface, opposed to said recording medium, of said recording means and/or said carriage is made smooth to form a smooth portion, said ink jet recording apparatus comprising:

judging means for judging occurrence of a curl of said recording medium; and regulating means for limiting a moving range of said carriage so that said smooth portion is not moved out of said recording medium when said judging means judges that said curl will occur.

19. The ink jet recording apparatus according to claim 18, wherein said judging means judges occurrence of said curl on a basis of at least one of a kind of said recording medium, quality of a recorded image and presence/absence of a margin of said recording medium.

20. An ink jet recording apparatus for effecting recording by discharging ink from recording means mounted to a reciprocally moving carriage toward a recording medium, wherein an opposed surface, opposed to said recording medium, of said recording means and/or said carriage is made smooth to form a smooth portion, said ink jet recording apparatus comprising:

judging means for judging occurrence of a curl of said recording medium;

regulating means for limiting a moving range of said carriage so that said smooth portion is not moved out of said recording medium when said judging means judges that said curl will occur; and a preliminary discharge receiving portion disposed within said moving range of said carriage limited by said regulating means and adapted to receive ink preliminary discharged to recover said recording means.

21. An ink jet recording apparatus for recording by discharging ink onto a recording medium from recording means mounted on a carriage, said apparatus comprising:

moving means for moving said carriage in a first direction and a second direction opposed to said first direction;

a first slide portion movable with said carriage for sliding said recording medium under said carriage when said first slide portion makes contact with said recording medium while said carriage moves in said first direction;

a second slide portion movable with said carriage for sliding said recording medium under said carriage when said second slide portion makes contact with said recording medium while said carriage moves in said second direction; and control means for controlling said moving means in a manner that said carriage moves within a range from a position where only one of said first slide portion and said second slide portion is opposed to said recording medium to a position wherein only another of said first slide portion and said second slide portion is opposed to said recording medium while said recording apparatus records on said recording medium in accordance with recording data.

22. The apparatus according to claim 21, wherein said first slide portion and said second slide portion slide said recording medium under a discharge port surface of said recording means.

23. The apparatus according to claim 22, wherein said first slide portion and said second slide portion have slant portions for sliding said recording medium under said discharge port surface of said recording means.

24. The apparatus according to claim 21, wherein said control means controls said moving means to move said carriage in said first direction and to change a moving direction of said carriage to said second direction when said second slide portion faces an end of said recording medium.

25. The apparatus according to claim 21, wherein said control means controls said moving means to move said carriage in said second direction and to change a moving direction of said carriage to said first direction when said first slide portion faces an end of said recording medium.

26. The apparatus according to claim 21, wherein a preliminary discharge receiving portion for receiving preliminarily discharged ink for recovering said recording means is provided at a position opposed to said recording means stopped at a position where only one of said first slide portion and said second slide portion is opposed to said recording medium.

27. An ink jet recording method for recording by discharging ink onto a recording medium from recording means mounted on a carriage, said method comprising the steps of:

providing a first slide portion to slide said recording medium under said carriage when said first slide portion is in contact with said recording medium while said carriage moves in a first direction;

providing a second slide portion to slide said recording medium under said carriage when said second slide portion is in contact with said recording medium while said carriage moves in a second direction opposed to said first direction; and moving said carriage within a range from a position where only one of said first slide portion and said second slide portion is opposed to said recording medium to a position where only another of said first slide portion and said second slide portion is opposed to said recording medium.

28. The method according to claim 27, wherein said first slide portion and said second slide portion slide said recording medium under a discharge port surface of said recording means.

29. The method according to claim 28, wherein said first slide portion and said second slide portion have slant portions for sliding said recording medium under said discharge port surface of said recording means.

30. The method according to claim 27, wherein said carriage moves in said first direction and is changed to move in said second direction when said second slide portion faces an end of said recording medium.

31. The method according to claim 27, wherein said carriage moves in said second direction and is changed to move in said first direction when said first slide portion faces an end of said recording medium.

32. An ink jet recording apparatus for recording by discharging ink onto a recording medium from a recording means mounted on a carriage, said apparatus comprising:

moving means for moving said carriage in a first direction and a second direction opposed to said first direction;

a first slide portion movable with said carriage for sliding said recording medium under said carriage when said recording medium floats toward said carriage while said carriage moves in said first direction;

a second slide portion movable with said carriage for sliding said recording medium under said carriage when said recording medium floats toward said carriage while said carriage moves in said second direction; and control means for controlling said moving means in a manner that said carriage moves within a range from a position where only one of said first slide portion and said second slide portion is opposed to said recording medium to a position where only another of said first slide portion and said second slide portion is opposed to said recording medium while said recording apparatus records on said recording medium in accordance with recording data.

33. The apparatus according to claim 32, wherein said first slide portion and said second slide portion slide said recording medium under a discharge port surface of said recording means.

34. The apparatus according to claim 33, wherein said first slide portion and said second slide portion have slant portions for sliding said recording medium under said discharge port surface of said recording means.

35. The apparatus according to claim 32, wherein said control means controls said moving means to move said carriage in said first direction and to change a moving direction of said carriage to said second direction when said second slide portion faces an end of said recording medium.

36. The apparatus according to claim 32, wherein said control means controls said moving means to move said carriage in said second direction and to change a moving direction of said carriage to said first direction when said first slide portion faces an end of said recording medium.

37. The apparatus according to claim 32, wherein a preliminary discharge receiving portion for receiving preliminary discharged ink for recovering said recording means is provided at a position opposed to said recording means stopped at a position where only one of said first slide portion and said second slide portion is opposed to said recording medium.

38. An ink jet recording method for recording by discharging ink onto a recording medium from recording means mounted on a carriage, said method comprising the steps of:

providing a first slide portion to slide said recording medium under said carriage when said recording medium floats toward said carriage while said carriage moves in said first direction;

providing a second slide portion to slide said recording medium under said carriage when said recording medium floats toward said carriage while said carriage moves in said second direction opposed to said first direction; and moving said carriage with a range from a position where only one of said first slide portion and said second slide portion is opposed to said recording medium to a position where only another of said first slide portion and said second slide portion is opposed to said recording medium.

39. The method according to claim 38, wherein said first slide portion and said second slide portion slide said recording medium under a discharge port surface of said recording means.

40. The method according to claim 39, wherein said first slide portion and said second slide portion have slant portions for sliding said recording medium under said discharge port surface of said recording means.

41. The method according to claim 40, wherein said carriage is moved to said first direction and a moving direction of said carriage is changed to said second direction when said second slide portion faces an end of said recording medium.

42. The method according to claim 40, wherein said carriage is moved to said second direction and a moving direction of said carriage is changed to said first direction when said first slide portion faces an end of said recording medium.

43. An ink jet recording apparatus for recording by discharging ink onto a recording medium from a recording means mounted on a carriage, said apparatus comprising:

moving means for moving said carriage in a first direction and a second direction opposed to said first direction;

a first slide portion movable with said carriage for sliding said recording medium under said carriage when said first slide portion makes contact with said recording medium while said carriage moves in said first direction;

a second slide portion movable with said carriage for sliding said recording medium under said carriage when said second slide portion makes contact with said recording medium while said carriage moves in said second direction; and control means for controlling said moving means such that said carriage moves from a first position where only one of said first slide portion and said second slide portion is opposed to a side end of said recording medium to a second position where only another of said first slide portion and said second slide portion is opposed to a side end of said recording medium and such that said carriage returns to said first position.

44. The apparatus according to claim 43, wherein said first slide portion and said second slide portion have slant portions for sliding said recording medium under a discharge port surface of said recording means.

45. The apparatus according to claim 43, wherein said control means controls said moving means such that said carriage reciprocates between said first position and said second position.

* * * * *

UNITED STATES PATENT AND TRADEMARK OFFICE

CERTIFICATE OF CORRECTION

PATENT NO. : 7,048,354 B2
APPLICATION NO. : 10/214300
DATED : May 23, 2006
INVENTOR(S) : Norihiro Kawatoko et al.

It is certified that error appears in the above-identified patent and that said Letters Patent is hereby corrected as shown below:

COLUMN 2:

Line 47, “recoding” should read --recording--;
Line 57, “damaged” should read --damaged enough--; and
Line 60, “been” should read --be--.

COLUMN 3:

Line 36, “a” should be deleted;
Line 47, “a” should be deleted; and
Line 60, “invention” should read --invention is--.

COLUMN 4:

Line 10, “portion” should read --portions--; and
Line 15, “portion” should read --portions--.

COLUMN 5:

Line 22, “servers” should read --serves--.

COLUMN 6:

Line 44, “than” should read --and--.

COLUMN 7:

Line 55, “a” should be deleted.

COLUMN 8:

Line 58, “mechanism,” should read --mechanisms,--; and
Line 67, “a” should be deleted.

COLUMN 11:

Line 36, “preliminary” should read --preliminarily--.

UNITED STATES PATENT AND TRADEMARK OFFICE

CERTIFICATE OF CORRECTION

PATENT NO. :7,048,354 B2
APPLICATION NO. :10/214300
DATED : May 23, 2006
INVENTOR(S) : Norihiro Kawatoko et al.

It is certified that error appears in the above-identified patent and that said Letters Patent is hereby corrected as shown below:

COLUMN 12:

Line 21, “recoding)” should read --recording)--.

COLUMN 16:

Line 1, “recoding” should read --recording--; and
Line 11, “preliminary” should read --preliminarily--.

COLUMN 17:

Line 8, “preliminary” should read --preliminarily--.

COLUMN 19:

Line 5, “liminary” should read --liminarily--; and
Line 22, “with” should read --within--.

Signed and Sealed this

Twenty-eighth Day of November, 2006

JON W. DUDAS
*Director of the United States Patent and Trademark Office*